US005410134A

United States Patent [19]

Marcut et al.

[11] Patent Number: 5,410,134

[45] Date of Patent: Apr. 25, 1995

[54] CLAMP FOR A WATER-COOLED INDUCTION COIL

[75] Inventors: Alexander Marcut, Alhambra; Victor E. DeLucia, Valley Village, both of Calif.

[73] Assignee: L.C. Miller Company, Monterey Park, Calif.

[21] Appl. No.: 279,419

[22] Filed: Jul. 25, 1994

[51] Int. Cl.[6] ..... H05B 6/42

[52] U.S. Cl. ..... 219/676; 219/677; 336/62; 174/15.6

[58] Field of Search ..... 219/676, 677, 632; 336/60, 62; 174/15.1, 15.6

[56] References Cited

U.S. PATENT DOCUMENTS

| | | | |
|---|---|---|---|
| 2,866,880 | 12/1958 | Miller | 219/677 |
| 3,495,063 | 2/1970 | Miller | 219/677 |
| 3,534,198 | 10/1970 | Miller | 219/676 |
| 4,714,808 | 12/1987 | Brolin | 219/677 |

*Primary Examiner*—Philip H. Leung

[57] ABSTRACT

A clamp assembly includes a yoke having a rectangular configuration and circumscribes a rectangular space, and a pair of spaced electrically conductive terminal bodies mounted in the rectangular space of the yoke. The terminal bodies are adapted to be connected to corresponding electrical terminals of an induction heating machine. A clamp pad is slidably mounted in the rectangular space of the yoke and is moveable vertically toward and away from the tops of the terminal bodies. An induction coil assembly including a hollow induction coil and a pair of spaced parallel elongated terminal bars is provided, with the terminal bars removably clamped between the clamp pad and the tops of the terminal bodies. Each of the terminal bodies contains a side port and a hollow valve stem which protrudes through its top in alignment with a port in a corresponding one of the terminal bars and contains a port aligned with the corresponding side port only when the terminal bars are clamped against the tops of the terminal bodies, thereby enabling coolant to flow into the side port of one terminal body and circulate through the induction coil and out of the side port of the other terminal body. An indicator may be mounted in the clamp pad to indicate when coolant is flowing and when it is safe to activate the assembly.

5 Claims, 2 Drawing Sheets

FIG. 1
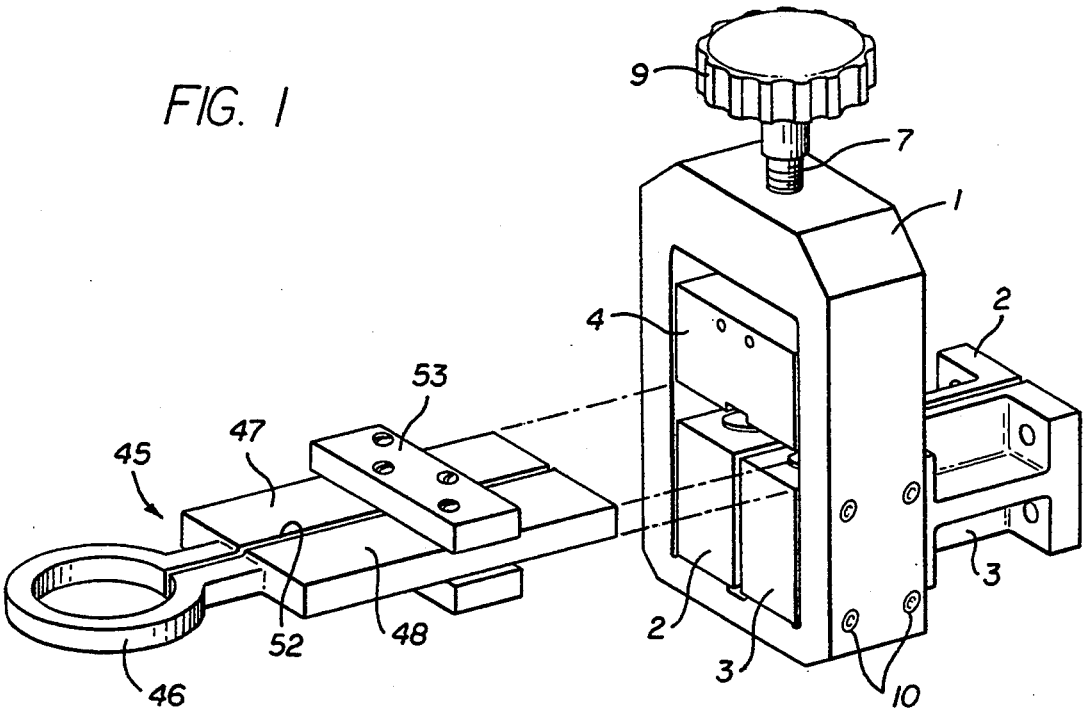
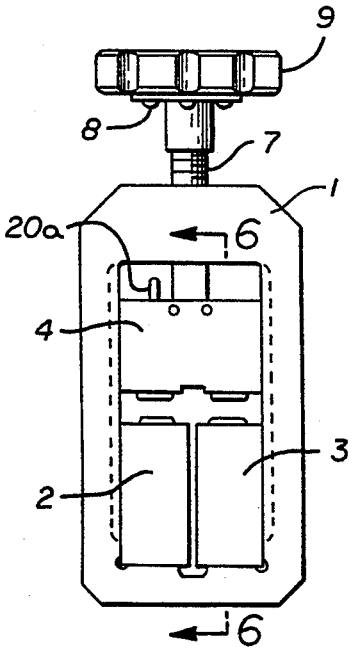
FIG. 2
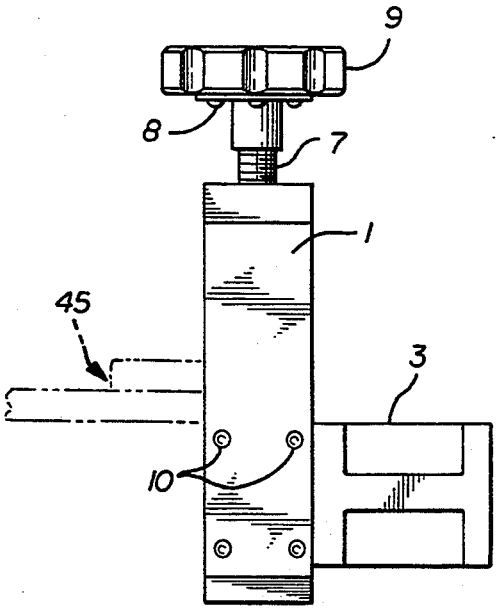
FIG. 3

CLAMP FOR A WATER-COOLED INDUCTION COIL

BACKGROUND OF THE INVENTION

The invention relates to an improved clamp for supporting a water-cooled induction coil for an induction heating machine, and which permits the coil to be easily removed from the machine and replaced by another water-cooled coil of the same or different size.

The clamp of the invention is of the same general type as the clamp fixture shown and described in U.S. Pat. No. 2,866,880 which issued Dec. 30, 1958, and which is assigned to the present assignee.

As described in U.S. Pat. No. 2,866,880, prior art induction heating machines are commonly provided with an output electrical terminal block for delivering high frequency electrical energy to the water-cooled induction heating coils associated with such machines. The patent describes an improved form of clamp fixture which is connected to the output terminal block of an induction heating machine and which serves removably to support the induction coil.

Induction heating coils used in the prior art induction heating machines are usually formed of metal tubing so that water or other coolant may be circulated through the coils. It is most important that water or other coolant be circulated through the coils whenever they are electrically energized in order to prevent overheating and resulting damage.

The clamp fixture described in U.S. Pat. No. 2,866,880 is constructed not only to support the induction heating coil in proper electrical contact with the electrical terminal block of an induction heating machine, but also to provide appropriate coupling to a coolant source for circulating a coolant through the coil.

The clamp fixture described in U.S. Pat. No. 2,866,880 includes in one embodiment manually operated valves in the coolant line to shut off the coolant whenever the coil is to be removed from the machine. A second embodiment of the clamp fixture described in the patent incorporates the coolant valve which is automatically turned off when the clamp is loosened to permit the coil to be removed. Also, when a new coil is inserted in the clamp and when the clamp is tightened, the coolant valve is automatically turned on in that particular embodiment. The mechanism of the second embodiment described in the patent assures that at no time will the coil be energized when no coolant is flowing through it. This provides a positive means to preclude severe damage which could result in destruction of the coil, and possible damage to the induction heating machine itself.

However, the second embodiment of the clamp fixture described in the patent is fairly complex, and an objective of the present invention is to provide a sturdy and simplified clamp assembly which achieves the desired results of the clamp fixture of the second embodiment of the patent by means of a simplified structure.

BRIEF SUMMARY OF THE INVENTION

An improved clamp fixture for a water-cooled hollow induction coil is provided which is connected directly to the terminal block of an induction heating machine, and which enables a change to be made from one induction coil to another in a matter of seconds. The clamp fixture of the invention includes a one-piece solid insulated yoke having a rectangular configuration and circumscribing a rectangular space. A pair of spaced electrically conductive terminal bodies are mounted in the yoke and spaced from its top. The terminal bodies are constructed to be connected to corresponding electrical terminals of the terminal block of the induction heating machine. A clamp pad assembly is slidably mounted in the yoke for vertical movement toward and away from the tops of the terminal bodies, and a manually or otherwise operated screw is connected through the top of the yoke to the clamp pad assembly for moving the clamp pad assembly toward and away from the tops of the terminal bodies. A removable induction coil assembly is provided which includes a hollow induction coil and two spaced parallel elongated electrically conductive terminal bars connected to the respective ends of the induction coil. The terminal bars are adapted to be removably clamped between the clamp pad assembly and the tops of the terminal bodies. Each of the terminal bodies contains a vertically extending spring-biased hollow valve stem which protrudes through its top in alignment with a port in the corresponding terminal bar. Each of the terminal bodies contains a side port, and each of the valve stems contains a port which is aligned with the corresponding side port in the corresponding terminal body only when the terminal bars are clamped in place against the tops of the terminal bodies. This action enables coolant to flow into one of the side ports of one of the terminal bodies to be circulated through the corresponding elongated conductive member, through the hollow induction coil and other elongated conductive member and out the side port of the other terminal body. A bellows-type indicator may be mounted on the clamping pad which responds to the flow of coolant through the induction coil to indicate that coolant is actually flowing through the coil.

BRIEF DESCRIPTION OF THE DRAWINGS

FIG. 1 is a detached perspective view showing the clamp assembly of the invention, in one of its embodiments, and an induction work coil assembly which is adapted to be clamped in place by the clamp assembly;

FIG. 2 is a elevational view of the front of the clamp assembly of FIG. 1;

FIG. 3 is an elevational view of one side of the clamp assembly of FIG. 1;

DETAILED DESCRIPTION OF THE ILLUSTRATED EMBODIMENT

Figure 4:
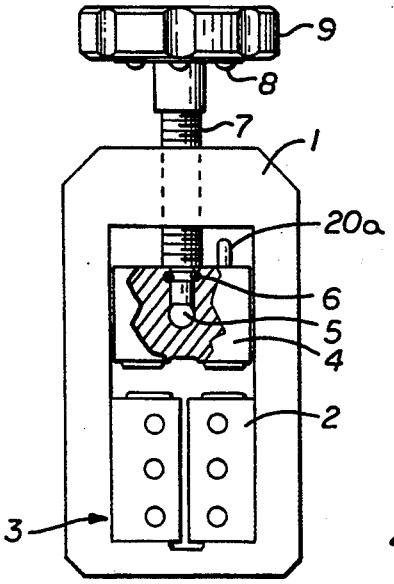
FIG. 4 is an elevational view, partly in section, of the clamp assembly of FIG. 1 taken from the rear.
Figure 5:
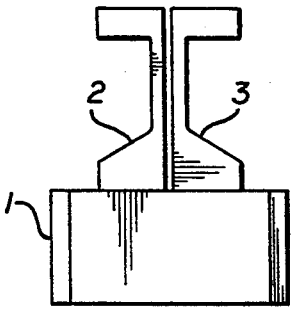
FIG. 5 is a bottom view of the clamp assembly of FIG. 1.

The clamp assembly of the invention as shown in the illustrated embodiment of FIGS. 1–6 comprises a yoke 1 composed of a one-piece solid and rigid insulating material. Yoke 1 has a rectangular configuration, as shown, and circumscribes a rectangular space. A pair of spaced electrically conductive terminal bodies 2 and 3 are mounted in the rectangular space defined by the yoke and secured to the yoke by screws 10. The terminal bodies protrude through the rear of the yoke and are constructed to be connected to corresponding electrical terminals of the terminal block of the induction heating machine (not shown) on which the clamp assembly is mounted by any appropriate means.

A clamp pad 4 is slidably mounted in the yoke 1 for vertical movement toward and away from the tops of the terminal bodies 2 and 3. A manually operated clamp screw 7 is threaded through the top of the yoke and is connected to the clamp pad for moving the clamp pad toward and away from the tops of the terminal bodies as the knob 9 is turned. Knob 9 is mounted on the upper end of the clamp screw 7 by screws 8. An induction coil assembly 45 (FIG. 1) is provided which includes a hollow induction work coil 46, and a pair of spaced elongated electrically conductive terminal bars 47 and 48 which are connected to the respective ends of the induction coil.

A pair of insulating cross members, such as cross member 53, are secured to the terminal bars 47 and 48 to hold the terminal bars in their spaced and parallel position, and to also operate as a stop when the terminal bars 47, 48 are inserted into the clamping mechanism between the clamp pad 4 and the tops of terminal bodies 2 and 3. When the electrically conductive terminal bars are clamped between the clamp pad 4 and the tops of the electrically conductive terminal bodies 2, 3, electrical connection is established from the terminal bars 47 and 48 to respective ones of the terminal bodies 2 and 3, and, accordingly, the induction work coil 45 is electrically connected to the electrical terminals of the terminal block of the induction heating machine.

Each of the terminal bars 47 and 48 has a longitudinal passage extending therethrough, and each of the terminal bodies 2 and 3 has a passage extending longitudinally therethrough so that coolant from an appropriate source may be circulated up to the terminal bar 47 through terminal body 2, through the hollow induction work coil 45, back through the other terminal bar 48, and back through the other terminal body 3.

Each of the terminal bodies 2, 3 contains a vertically extending hollow valve stem 11 (FIG. 6) which is spring-biased by a compression spring 12 so that its upper end normally protrudes beyond the top of the corresponding terminal body 2, 3. In the illustrated embodiment, the valve stem is forced back into the corresponding terminal body 2, 3, against the force of compression spring 12, as the terminal bars 47, 48 are clamped in place.

Figure 6:
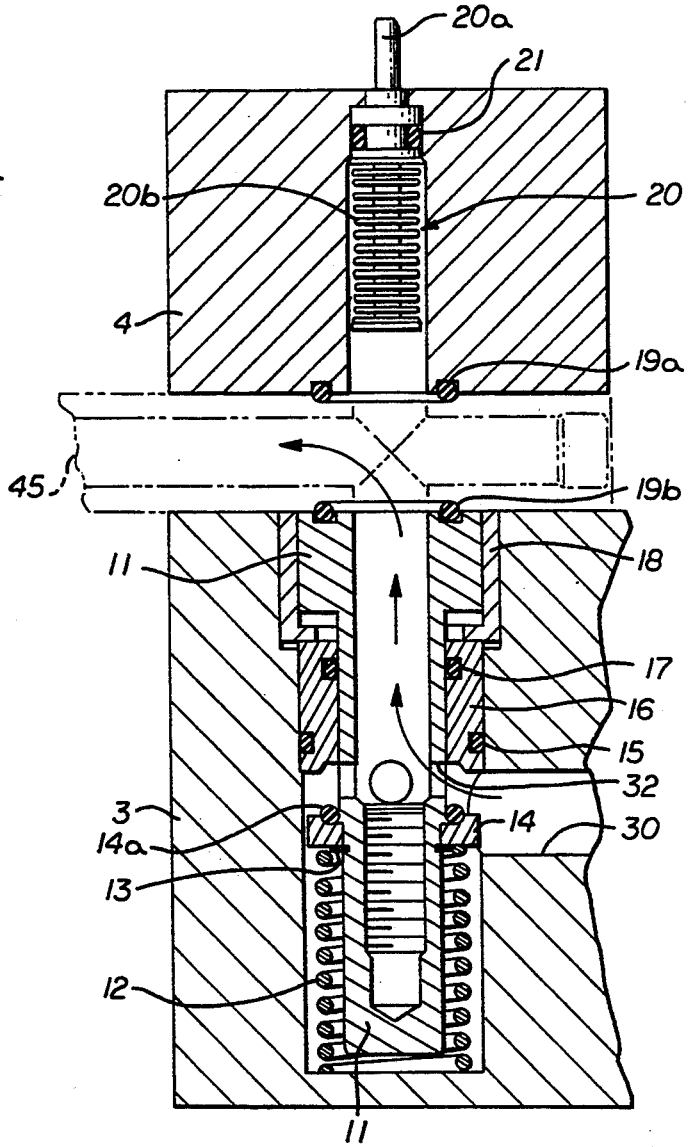
FIG. 6 is a section taken substantially along the line 6—6 of FIG. 2.

As best shown in FIG. 6, each of the terminal bodies has a number of side ports 30, and each of the valve stems contains a number of ports 32 which are aligned with the ports 30 in the corresponding terminal body only when the terminal bars 47 and 48 are clamped between the clamping pad 4 and the terminal bodies 2 and 3, when the assembly is in its operating position, as is the case in the representations of FIGS. 2, 3, 4 and 6. In the non-operating position the valve stems 11 are raised above the tops of terminal bodies 2 and 3 with O-rings 142 sealing the water flow against bushing 16.

The side ports 32 of the valve stem 11 are aligned with the ports 30 only when the corresponding valve stems have been depressed to the position shown in FIG. 6. That occurs when the assembly is in its operating position, and terminal bars 47 and 48 of the coil assembly 45 are clamped in place, as shown in FIGS. 2, 3, 4 and 6. When that occurs, the ports 32 are aligned with the corresponding ports 30, so that coolant can flow through ports 30 into the interior of the valve stem 11 and up through the valve stem and out the top of the valve stem and into the longitudinal passage in the corresponding elongated member 47, 48 and through the work coil 45.

As shown in FIG. 6, each of the terminal bodies 2, 3 includes a slide retainer 18 in which the valve stem 11 is held in a sliding position. The assembly also includes a bushing 16, as shown, and sealing is provided by O-rings 15 and 17. The assembly also includes a valve seat 14 and a ring 13 which serves to limit the upward movement of the movable valve stem 11. O-rings **19*a*, 19*b* serve to seal the terminal bars 47 and 48 to clamp pad 4 and to terminal bodies 2 and 3**.

When the coil assembly 45 is to be removed, the knob 9 is turned to cause the clamp pad 4 to move upwardly within the yoke 1 to release the terminal bars 47 and 48, so that the coil assembly 45 may be removed. When that occurs, the valve stems, such as valve stem 11 in FIG. 6, move upwardly to protrude beyond the top of the terminal bodies, such as terminal body 3 in FIG. 6, and the ports 32 become misaligned with port 30, so that the flow of coolant through the hollow coil 46 is automatically terminated. Then, when a new coil assembly is mounted, its terminal bars 47 and 48 are inserted between the clamp pad 4 and the tops of the terminal bodies 2 and 3, and clamp pad 4 is clamped down, so that electrical contact is established with the induction heating machine, and the valve stems such as valve stem 11, are moved back. to their lower position, as illustrated in FIG. 6, so that coolant may flow once more through the work coil 45.

In order to assure that coolant is indeed flowing through the work coil 46 when the assembly 45 is clamped in place, an indicator 20 is provided in the clamp pad 4, as shown in FIG. 6. This indicator is mounted in a passage through the clamp pad which is aligned with the hollow interior of the stem 11. Accordingly, when coolant flows through the stem 11, it also flows up through the passage in the clamp pad to engage a bellows **20*b*. Bellows 20*b* operates an indicating pin 20*a*. When the bellows is depressed by the flow of coolant into the passage in the clamp pad, the pin 20*a* is displaced up through the top of the clamp pad to be readily visible. However, when there is no coolant flow, the pin 20*a* drops down into the clamp pad to be no longer visible. An O-ring 21 is provided for sealing purposes. Indicator 20 provides a positive means for an operator to determine whether or not there is coolant flow through the coil 46** to assure that the Work coil will be energized only when coolant is flowing through it.

The invention provides, therefore, an improved clamping fixture for a water-cooled induction coil which connects directly to the terminal block of an induction coil heating machine, and which enables a change from one induction work coil to another to be made in a matter of seconds. At the same time, the clamping fixture of the invention provides a simple and straightforward mechanism for automatically turning off the flow of coolant whenever a work coil is removed, and for then automatically restoring the flow when the work coil is replaced. The apparatus of the invention also includes a simple indicator for positively informing an operator that there is indeed coolant flow through the induction coil before it is energized.

It will be appreciated that while a particular embodiment of the invention has been shown and described, modifications may be made. It is intended in the following claims to cover all such modifications which fall within the true spirit and scope of the invention.

We claim:

1. A clamp assembly comprising: A yoke having a rectangular configuration and circumscribing a rectangular space, said yoke having two sides, a top and a bottom; a pair of spaced electrically conductive terminal bodies mounted in said yoke extending through said rectangular space adjacent to said bottom and to respective ones of said sides and spaced from said top, said terminal bodies being adapted to be electrically connected to corresponding electrical terminals of a terminal block of an induction heating machine; a clamp pad slidably mounted in said yoke above said terminal bodies for vertical movement toward and away from the tops of said terminal bodies; operating means connected to said clamp pad for moving said clamp pad vertically toward and away from the tops of said terminal bodies; an induction coil assembly including a hollow induction coil and a pair of spaced parallel electrically conductive elongated terminal bars connected to the respective ends of said induction coil, the induction coil assembly being adapted to be removably clamped between said clamp pad and the tops of said terminal bodies with the electrically conductive terminal bars in electrical contact with respective ones of said terminal bodies, each of said terminal bars having a longitudinally-extending passage therethrough for circulating a coolant through said hollow induction coil, said elongated terminal bars having respective ports therein extending through the surfaces thereof and communicating with the longitudinally-extending passages therein; each of said terminal bodies including a vertically extending spring-biased hollow valve stem therein protruding through the top thereof in alignment with the port in the corresponding terminal bar; each of said terminal bodies having at least one side port therein, and each of said valve stems having at least one port therein to be aligned with the corresponding side port in the corresponding terminal body only when said elongated terminal bars are clamped against the tops of said terminal bodies to enable coolant flowing in the side port of one of said terminal bodies to be circulated through said induction coil and out the side port of the other of said terminal bodies.

2. The clamp assembly defined in claim 1, in which said yoke is formed of a one-piece rigid insulating member.

3. The clamp assembly defined in claim 1, in which said clamp pad has a passage extending therethrough for receiving coolant whenever the coolant is flowing through said induction coil, and an indicator assembly mounted in said last-named passage and responsive to the coolant therein for indicating that coolant is flowing through said induction coil.

4. The clamp assembly defined in claim 3 in which said indicator assembly includes a vertically moveable pin positioned to protrude through the top of said clamp pad when displaced to an extended position and to drop to the plane of the top of said clamp pad when in a retracted position, and a bellows responsive to the coolant pressure in said last-named passage to shift said pin from its retracted position to its extended position.

5. The clamp assembly defined in claim 1 in which said operating means comprises a screw threaded through the top of said yoke, and a knob mounted on the upper end of said screw.

* * * * *